US006031364A

United States Patent [19]

Hosono et al.

[11] Patent Number: 6,031,364

[45] Date of Patent: Feb. 29, 2000

[54] SERIES CONTROL TYPE REGULATOR

[75] Inventors: Rinya Hosono, Tsurugashima; Yukinori Kiya, Kawagoe, both of Japan

[73] Assignee: Toko, Inc., Tokyo, Japan

[21] Appl. No.: 09/363,599

[22] Filed: Jul. 29, 1999

[30] Foreign Application Priority Data

Aug. 21, 1998 [JP] Japan ..... 10-235823

[51] Int. Cl.[7] ..... G05F 1/56

[52] U.S. Cl. ..... 323/280; 323/284

[58] Field of Search ..... 323/269, 271, 323/272, 273, 274, 275, 280, 282, 284, 285

[56] References Cited

U.S. PATENT DOCUMENTS

| | | | |
|---|---|---|---|
| 5,309,082 | 5/1994 | Payne | 323/270 |
| 5,365,161 | 11/1994 | Inoue et al. | 323/282 |
| 5,563,500 | 10/1996 | Muterspaugh | 323/282 |
| 5,563,501 | 10/1996 | Chan | 323/282 |
| 5,828,206 | 10/1998 | Hosono et al. | 323/273 |

FOREIGN PATENT DOCUMENTS

| | | |
|---|---|---|
| 61-5324 | 1/1986 | Japan . |
| 4-40313 | 6/1992 | Japan . |
| 8-255028 | 1/1996 | Japan . |

*Primary Examiner*—Y. J. Han

*Attorney, Agent, or Firm*—Frishauf, Holtz, Goodman, Langer & Chick, P.C.

[57] ABSTRACT

The present invention provides a series control type regulator which can decrease rapidly an output voltage regardless of heaviness or lightness of a load when a first transistor for controlling an output voltage is set to a state of stop of operation. When a switching circuit sets the first transistor from a state of operation to a state of stop, at the same time an output capacitor is discharged by causing to a discharge circuit connected in parallel to the output capacitor. The discharge circuit starts operating by turning on a third transistor, which turns on by a current flowing to voltage dividing resistors of a detection circuit being used as a base current. The voltage dividing resistors of the detection circuit are also used as resistors for setting a base current of the third transistor.

2 Claims, 3 Drawing Sheets

SERIES CONTROL TYPE REGULATOR

BACKGROUND OF THE INVENTION

1. Field of the Invention

The present invention relates to a series control type regulator which can decrease rapidly an output voltage when operation of a transistor controlling the output voltage is stopped.

2. Description of the Prior Art

FIG. 1 shows a circuit of a conventional series control type regulator. Referring to FIG. 1, a first transistor Q1 is connected in series between an input terminal 1 and an output terminal 2 and a detection circuit 10, which comprises resistors R1 and R2 connected in series between the output terminal 2 and a ground, for detecting an output voltage $V_{OUT}$.

A node of the resistor R1 and R2 of the detection circuit 10 is connected to an inverted input terminal (−) to supply a detecting voltage corresponding to the output voltage $V_{OUT}$ to an error amplifier circuit 3. A non-inverted input terminal (+) of the error amplifier circuit 3 is connected to a reference voltage source to generate an output signal corresponding to the amount of deviation between a reference voltage $V_{REF}$ and the detecting voltage. An output terminal of the error amplifier circuit 3 is connected to a base of the transistor Q1 to control a base current of the transistor Q1 by means of the output signal of the error amplifier circuit 3. Thereby the transistor Q1 can change impedance between a collector and an emitter thereof according to the output signal of the error amplifier circuit 3 to control the output voltage $V_{OUT}$. By this operation of the transistor Q1, a predetermined output voltage $V_{OUT}$ can be obtained at the output terminal 2.

An output capacitor C1 is connected between the output terminal 2 and the ground to prevent a rapid change of a load and a noise generated in a regulator or the load from affecting badly the output voltage $V_{OUT}$. A capacitor having a large capacitance is usually used for the capacitor C1.

A switching circuit 4 and a switch 5 are connected between the input terminal 1 and the error amplifier circuit 3 and the transistor Q1 is set to a state of operation or a state of stop of operation through the switching circuit 4 and the error amplifier circuit 3 by an ON and OFF state of the switch 5.

An input voltage $V_{IN}$ of the input terminal 1 is supplied from an external dc source E1, but a main switch for connecting the dc source E1 to the input terminal 1 is omitted in the drawings.

In the circuit as shown in FIG. 1, when the switch 5 is ON, the transistor Q1 becomes an state of operation and a predetermined output voltage $V_{OUT}$ is obtained at the output terminal 2 by control operation of the transistor Q1. By any reason, however, in case of stopping a supply of the output voltage $V_{OUT}$ to a load from the series control type regulator, operation of the transistor Q1 is stopped rapidly by switching off the switch 5.

Setting the transistor Q1 to the state of stop may be carried out, for example, in a way of cutting off a bias current supplied to the error amplifier circuit 3 by the switching circuit 4 operating according to the switch 5, thereby stopping operation of the error amplifier circuit 3 to turn off the transistor Q1. Japanese Patent Application No. 7-86119 (Unexamined Patent Application Publication No. 8-255028) proposed by the same inventor as that of the present application discloses a concrete example of such a way.

Such a series control type regulator has been used as a power supply of a various of circuits or electronic apparatuses, and in particular, has been used extensively in these fields with recent development of portable digital communication apparatuses.

In recent digital communication apparatuses, in many cases, transmissions and receptions are performed rapidly repeatedly. For this, the regulator used as a power supply of the electric communication apparatuses is required to rise up and fall down the output voltage $V_{OUT}$ at high speed. However, many technologies for rising it up at high speed are known, but few technologies for falling it down at high speed are known.

In the circuit of FIG. 1, in case of setting the transistor Q1 to the state of stop to fall down the output voltage $V_{OUT}$, it will decrease rapidly if a load is heavy. In a light load, however, it will take a longer time than in the heavy load to decrease the output voltage $V_{OUT}$. This is because a discharge time of the output capacitor C1 becomes short if the load is heavy and becomes long if it is light. For example, we assume that although operation of a transistor for controlling an output voltage in the regulator stops, a receiving circuit connected to the regulator is still in operation because a falling speed of the output voltage is slow. In this case, if operation of a transmitting circuit starts, a howling phenomenon will be generated between the receiving circuit and the transmitting circuit, and the receiving circuit might be damaged.

SUMMARY OF THE INVENTION

An object of the present invention is to provide a series control type regulator which can fall down an output voltage rapidly regardless of lightness or heaviness of the load when operation of the transistor for controlling the output voltage is set to a state of stop.

The regulator circuit of the present invention comprises: a first transistor for controlling an output voltage, a main current path of which is connected between an input terminal and an output terminal; a detection circuit, which includes a plurality of voltage dividing resistors and a second transistor connected in series, for detecting an output voltage; an error amplifier circuit for supplying an output signal obtained by comparing a detecting voltage corresponding to the output voltage supplied from the detection circuit with a reference voltage, to a control terminal of the first transistor; an output capacitor, one end of which is connected to the output terminal; a discharge circuit having a third transistor, a main current path of which is connected in parallel to the output capacitor; and a switching circuit for setting the first transistor to a state of operation or a state of stop of operation, and wherein when the first transistor is set from the state of operation to the state of stop by the switching circuit, a current flowing to the voltage dividing resistors of the detection circuit is used as a base current of the third transistor by turning off the second transistor, thereby turning on the third transistor and causing the output capacitor to discharge through the third transistor.

The regulator circuit of the present invention, when the first transistor is set from the state of operation to the state of stop, causes to operate simultaneously the discharge circuit connected in parallel to the output capacitor to discharge the output capacitor, thereby decreasing down the output voltage rapidly regardless of lightness or heaviness of the load.

The discharge circuit starts operation by turning on the third transistor, which is turned on by using the current flowing to the voltage dividing resistors of the detection circuit as the base current. In other words, the voltage dividing resistors of the detection circuit is also used as resistors for setting the base current of the third transistor.

For this, it is needless to provide newly a resistor for setting the base current of the third transistor and an integrated circuit forming the regulator can be small in size. Also, even though a value of the output voltage changes, it is advantageous that the base current of the third transistor is constant, and a discharging time in the discharge circuit does not change in accordance with the output voltage.

DESCRIPTION OF THE PREFERRED EMBODIMENT

Figure 2:
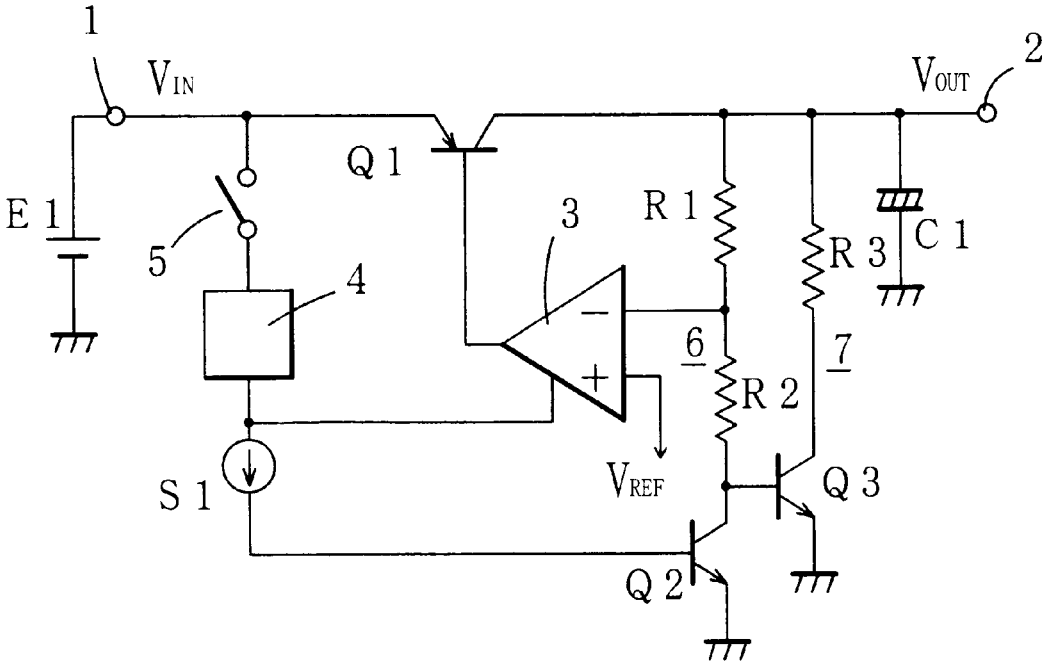
FIG. 2 is a circuit of a first embodiment of the series control type regulator according to the present invention.

Referring now to the drawings, wherein like reference numerals designate identical or corresponding parts throughout the several views, FIG. 2 shows a first embodiment of a series control type regulator according to the present invention.

In FIG. 2, a first transistor Q1 of a PNP type controlling an output voltage $V_{OUT}$ is connected in series between an input terminal 1 and an output terminal 2. A dc supply E1 such as a battery or the like is connected to the input terminal 1 to which an input voltage $V_{IN}$ is supplied. One end of an output capacitor C1 is connected to the output terminal 2 and another end thereof is grounded.

A discharge circuit 7 consisting of a resistor R3 and a third transistor of an NPN type is connected in parallel to the output capacitor C1. One end of the resistor R3 of the discharge circuit 7 is connected to the output terminal 2, and a collector of the transistor Q3 is connected to another end of the resistor R3, an emitter thereof being grounded.

A detection circuit 6 for detecting the output voltage $V_{OUT}$ is formed by resistors R1 and R2 and a second transistor Q2 of an NPN type, which are connected in series. One end of the resistor R1 is connected to the output terminal 2, another end thereof being connected to one end of the resistor R2. A collector of the transistor Q2 is connected to another end of the resistor R2, an emitter thereof being grounded. A node of the resistor R2 and the collector of the transistor Q2 is connected to a base of the transistor Q3 of the discharge circuit 7.

An inverted input terminal (−) of the error amplifier circuit 3 is connected to the node of the resistors R1 and R2 of the detection circuit 6, non inverted input terminal (+) thereof being connected to a reference voltage power supply outputting a reference voltage $V_{REF}$, and an output terminal thereof is connected to a base of the transistor Q1.

A switching circuit 4 is connected to the input terminal 1 through a switch 5 operated from an external, and a signal output terminal of the switching circuit 4 is connected to a base of the transistor Q2 of the detection circuit 6 through a constant current source S1, and the error amplifier circuit 3, respectively.

The series control type regulator configured like this operates as follows.

When the switch 5 is On, a signal from the switching circuit 4 is applied to both the error amplifier circuit 3 and the constant current source S1. Accordingly, a current from the constant current source S1 is supplied to the base of the transistor Q2 of the detection circuit 6, and the transistor Q2 is turned on. When the transistor Q2 turns on, the detection circuit 6 starts operating, and at the same time, also, the error amplifier circuit 3 operates to set the transistor Q1 to a state of operation.

Figure 1:
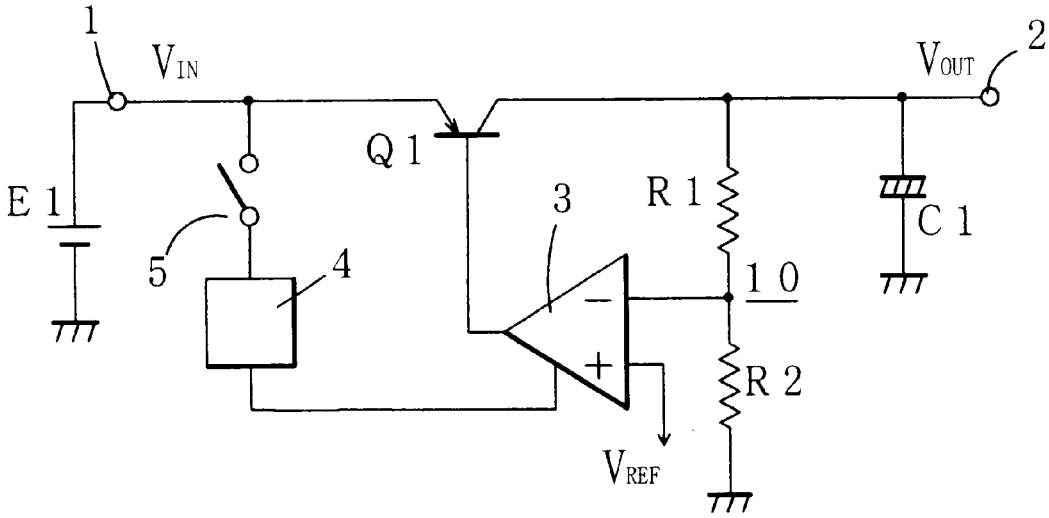
FIG. 1 (PRIOR ART)
FIG. 1 is a circuit showing a conventional series control type regulator.

When the transistor Q1 is at the state of operation, a control of the output voltage $V_{OUT}$ is the same as that of the conventional regulator as shown in FIG. 1 and its explanation is omitted.

On the other hand, when the switch 5 is OFF and supply of the signal from the switching circuit 4 stops, supply of the current to the base of the transistor Q2 from the constant current source S1 stops to turn off the transistor Q2. The detection circuit 6 is cut off by the transistor Q2 which is turned off.

Further, when supply of the signal from the switching circuit 4 stops, operation of the error amplifier circuit 3 stops as well. Consequently, the transistor Q1 to which an output signal from the error amplifier circuit 3 is supplied is entirely turned off to be set to a state of stop of operation.

While the transistor Q2 is in an ON state, the current flows passing through the resistors R1, R2 and the transistor Q2. When the transistor Q2 is turned off by the switch 5 which is OFF, however, the current passing through the resistors R1, R2 flows into the base of the transistor Q3. Consequently, the transistor Q3 turns on, and the discharge circuit 7 starts operation. Accordingly, the output capacitor C1 discharges through the resistor R3 and the transistor Q3 of the discharge circuit 7.

At this time, the base current of the transistor Q3 is set by the resistors R1, R2 of the detection circuit 6. Even if the output voltage $V_{OUT}$ is set to another value by changing a value of the resistor R1, the base current will be constant.

This is because a voltage of the node of the resistors R1 and R2 becomes the same value as the reference voltage $V_{REF}$ by the error amplifier circuit 3 and do not change even if a value of the resistor R1 is changed. For example, in case that the reference voltage is 1.25 V and each resistance of the resistors R1 and R2 is 100 kΩ, the output voltage $V_{OUT}$ of 2.5 V is obtained, and in case that the reference voltage is 1.25 V and the resistance of the resistor R1 is 100 kΩ and that of the resistor R2 is 300 kΩ, the output voltage $V_{OUT}$ of 5 V is obtained, but the base current is 12.5 μA in either case. Thus, it is possible to make a discharge characteristic of the discharge circuit 7 constant regardless of the value of the output voltage $V_{OUT}$.

It is noted that the resistor R3 of the discharge circuit 7 is provided so that dispersion of a current amplification constant of the transistor Q3 does not affect a collector current. However, in case of a little affection, it may be omitted.

Figure 3:
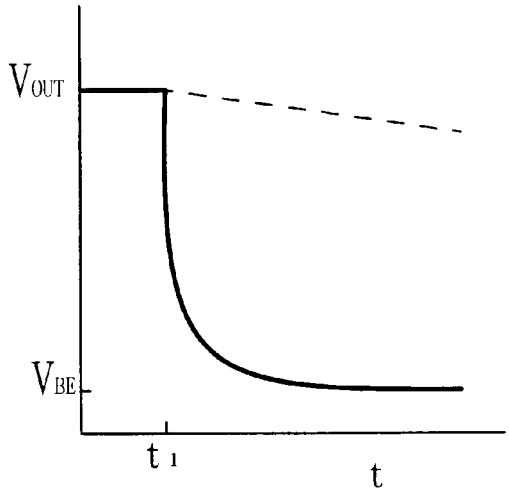
FIG. 3 is a diagram showing a discharge characteristic of the series control type regulator as shown in FIG. 2.

FIG. 3 is a diagram showing a discharge characteristic of the regulator as shown in FIG. 2 and indicates time t as the axis of abscissa and the output voltage $V_{OUT}$ as the axis of ordinate. At time t1 the transistor Q1 stops operating, and the output voltage $V_{OUT}$ which is a predetermined value until just prior to t1 decreases rapidly after time t1. In an actual circuit, the output voltage $V_{OUT}$ does not decrease than a base-emitter voltage $V_{BE}$. It is, however, sufficient to decrease until this level in order to cause a circuit as a load not to operate and in particular, there is no problem. A dot line in FIG. 3 shows a characteristic of the conventional circuit of FIG. 1.

Figure 4:
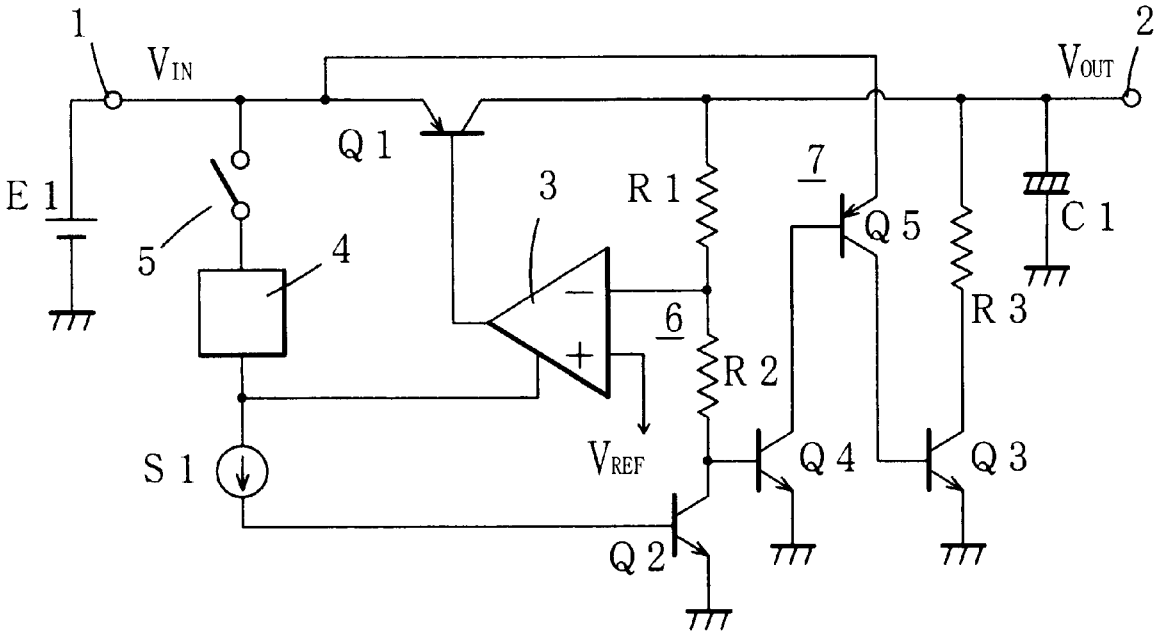
FIG. 4 is a circuit of a second embodiment of the series control type regulator according to the present invention.

FIG. 4 shows a circuit of a second embodiment of the series control type regulator according to the present invention. The circuit of FIG. 4 is different from that of FIG. 2 in that a discharge circuit 7 comprises three transistors of a third transistor Q3, a fourth transistor Q4 and a fifth transistor Q5. That is, a base of the transistor Q4 of an NPN type is connected to a node of a resistor R2 and the transistor Q2 of a detection circuit 6, a collector thereof is connected to a base of the transistor Q5 of a PNP type and an emitter thereof is grounded. An emitter of the transistor Q5 is connected to an input terminal 1, and a collector thereof is to a base of the transistor Q3. A collector of the transistor Q3 is connected to an output terminal 2 through a resistor R3 and an emitter thereof is grounded. Thereby the discharge circuit 7 connected in parallel to an output capacitor C1 is formed.

As described below, this circuit of FIG. 4 performs the same operation as that of FIG. 2.

When the transistor Q1 is in a state of stop by turning off a switch 5, supply of a base current to the transistor Q2 from a constant current source S1 stops. Accordingly, the transistor Q2 turns off, and a detection circuit 6 is cut off. At this time the current flowing to resistors R1 and R2 supplies a base current to the transistor Q4. This base current is amplified at two stage of the transistors Q4 and Q5 to supply the base current to the transistor Q3. Accordingly, the transistor Q3 turns on and an output capacitor C1 discharges through the resistor R3 and the transistor Q3. It is noted that in the circuit of FIG. 4, the base current of the transistor Q3 is also set to be indirectly approximately constant by the resistors R1 and R2.

Figure 5:
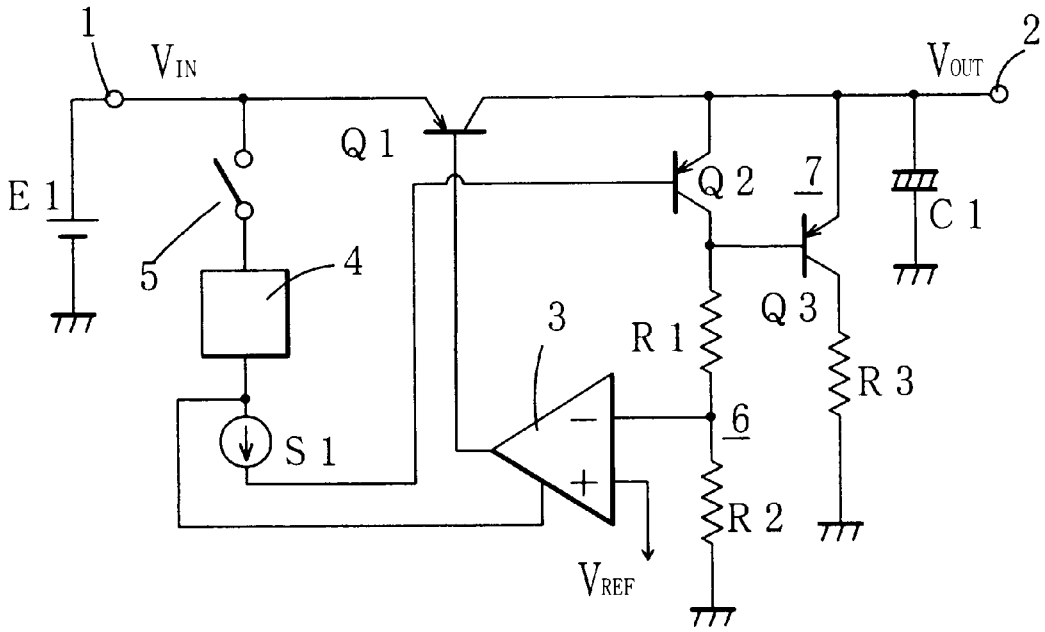
FIG. 5 is a circuit of a third embodiment of the series control type regulator according to the present invention.

FIG. 5 shows a circuit of a third embodiment of the series control type regulator according to the present invention. The circuit of FIG. 5 is different from that of FIG. 2 in that a second transistor Q2 of a detection circuit 6 and a third transistor Q3 of a discharge circuit 7 are a PNP type, respectively.

In a circuit of FIG. 5, when a switch 5 is OFF, a base current flows out of the transistor Q2 to a constant current source S1 is stopped by the switching circuit 4. Accordingly, the transistor Q2 turns off to cut off the detection circuit 6. At this time a base current of the transistor Q3 flows into resistors R1, R2 and the transistor Q3 turns on. An output capacitor C1 discharges through the transistor Q3 which turns on and the resistor R3.

Figure 6:
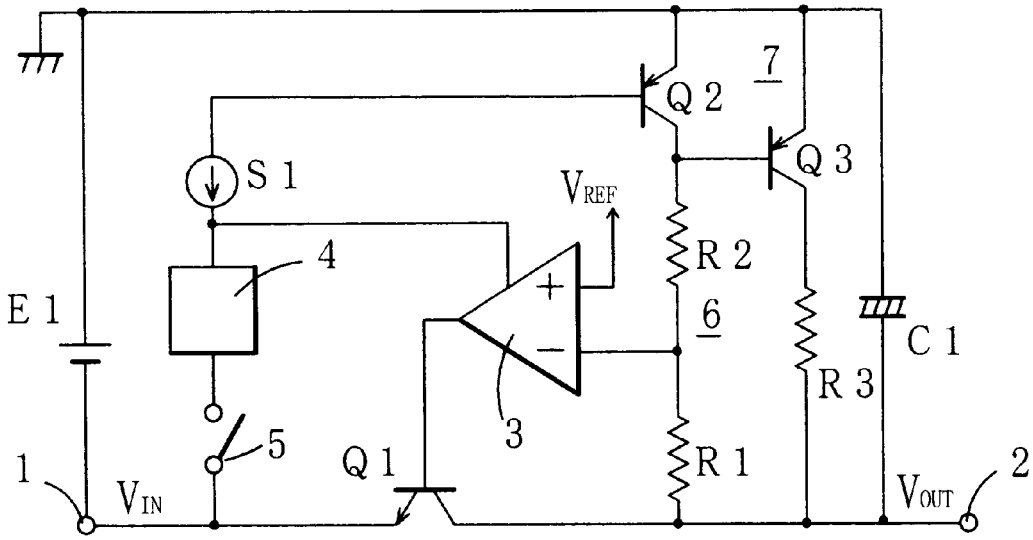
FIG. 6 is a circuit of a fourth embodiment of the series control type regulator according to the present invention.

FIG. 6 shows a circuit of a fourth embodiment of the series control type regulator according to the present invention, in which a negative output voltage $V_{OUT}$ is obtained at an output terminal 2.

FIG. 6 is the same circuit as FIG. 5 except use of a first transistor Q1 of an NPN type.

We claim:

1. A series control type regulator comprising:

a first transistor for controlling an output voltage, a main current path of which is connected between an input terminal and an output terminal;

a detection circuit, which includes a plurality of voltage dividing resistors and a second transistor connected in series, for detecting an output voltage;

an error amplifier circuit for supplying an output signal obtained by comparing a detecting voltage corresponding to the output voltage supplied from the detection circuit with a reference voltage, to a control terminal of the first transistor;

an output capacitor, one end of which is connected to the output terminal;

a discharge circuit having a third transistor, a main current path of which is connected in parallel to the output capacitor; and a switching circuit for setting the first transistor to a state of operation or a state of stop of operation, and wherein when the first transistor is set from the state of operation to the state of stop by the switching circuit, a current flowing to the voltage dividing resistors of the detection circuit is used as a base current of the third transistor by turning off the second transistor, thereby turning on the third transistor and causing the output capacitor to discharge through the third transistor.

2. The series control type regulator according to claim 1, wherein the voltage dividing resistors are also used as resistors for setting a base current of the third transistor.

* * * * *